US012060764B2

(12) United States Patent
Schnell et al.

(10) Patent No.: US 12,060,764 B2
(45) Date of Patent: Aug. 13, 2024

(54) ACTIVATION OF WELLBORE SEALANTS WITH ULTRASONIC WAVES AFTER PLACEMENT IN A WELLBORE

(71) Applicant: Halliburton Energy Services, Inc., Houston, TX (US)

(72) Inventors: Ernst Rudolf Man Schnell, Houston, TX (US); Samuel J. Lewis, Houston, TX (US); Keith Edward Blaschke, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 105 days.

(21) Appl. No.: 17/958,113

(22) Filed: Sep. 30, 2022

(65) Prior Publication Data

US 2024/0110460 A1 Apr. 4, 2024

(51) Int. Cl.
*E21B 33/16* (2006.01)

(52) U.S. Cl.
CPC ..... *E21B 33/16* (2013.01)

(58) Field of Classification Search
CPC ..... E21B 33/13; E21B 33/14; E21B 33/16
See application file for complete search history.

(56) References Cited

U.S. PATENT DOCUMENTS 8,047,282 B2 11/2011 Lewis
2010/0050905 A1* 3/2010 Lewis ..... C04B 28/06 106/638
2010/0051275 A1 3/2010 Lewis et al.
2010/0087827 A1* 4/2010 Baroud ..... G01N 33/383 324/693
2011/0048697 A1 3/2011 Lewis et al.
2011/0048711 A1* 3/2011 Lewis ..... C09K 8/467 166/293
2011/0141847 A1* 6/2011 Frumin ..... E21B 49/006 367/35
2011/0272142 A1 11/2011 Lewis et al.
2014/0116298 A1 5/2014 Lewis et al.

FOREIGN PATENT DOCUMENTS

| | | |
|---|---|---|
| AU | 2020324503 | 3/2022 |
| CA | 3149126 | 2/2021 |
| CN | 111002450 | 4/2020 |
| CN | 114340862 | 4/2022 |
| DE | 102017206660 | 10/2018 |
| DE | 102019120939 | 2/2021 |
| DE | 102020132015 | 6/2022 |
| EP | 4013586 | 6/2022 |
| FR | 2933092 | 1/2010 |
| WO | 2019164469 | 8/2019 |
| WO | 2021023598 | 2/2021 |
| WO | 2022117571 | 6/2022 |

* cited by examiner

*Primary Examiner* — David Carroll
(74) *Attorney, Agent, or Firm* — Thomas Rooney; C. Tumey Law Group PLLC

(57) ABSTRACT

A method may comprise introducing an ultrasonic device into a wellbore with a cement slurry therein; generating ultrasonic waves with the ultrasonic device, wherein at least a portion of the ultrasonic waves are transmitted into at least a portion of the cement slurry; creating cavitation within at least the portion of the cement slurry with at least the portion of the ultrasonic waves; and allowing the cement slurry to set to form a hardened mass.

17 Claims, 10 Drawing Sheets

ACTIVATION OF WELLBORE SEALANTS WITH ULTRASONIC WAVES AFTER PLACEMENT IN A WELLBORE

BACKGROUND

Cement slurries are used in a variety of subterranean operations. For example, in subterranean well construction, a pipe string (e.g., casing, liner, expandable tubular, etc.) can be run into a wellbore and cemented in place. The process of cementing the pipe string in place is commonly referred to as "primary cementing." In a typical primary cementing method, a cement slurry may be pumped into a wellbore. The cement slurry may be pumped into an annulus between the walls of the wellbore and the exterior surface of the pipe string disposed therein. The cement slurry may set in the annular space, thereby forming an annular sheath of hardened, substantially impermeable cement (i.e., a cement sheath) that may support and position the pipe string in the wellbore and may bond the exterior surface of the pipe string to the subterranean formation. Among other things, the cement sheath surrounding the pipe string functions to prevent the migration of fluids in the annulus, as well as protecting the pipe string from corrosion. Cement compositions also may be used in remedial cementing methods, for example, to seal cracks or holes in pipe strings or cement sheaths, to seal highly permeable formation zones or fractures, to plug the wellbore with cement, and the like.

In well construction, a drill bit may be used to extend a wellbore through a subterranean formation. Oftentimes a wellbore is completed in stages whereby a first section of the wellbore is drilled, and a casing is cemented in place in the first section. After the cement has cured to form a hardened sheath, a smaller second section of the wellbore may be drilled to further extend the wellbore and a casing is cemented in place in the second section. The drilling and cementing operations may be repeated multiple times until the wellbore reaches the desired depth.

One consideration when drilling the wellbore may be the time for the cement to cure between cementing and drilling operations. Typically, the drilling operation cannot continue until the cement has reached a target compressive strength, oftentimes defined by regulatory bodies or by a customer requirement. The curing time may be on the order of hours to days depending, for example, on the complexity of the cement operation, composition of the cement, and wellbore characteristics. The down time where drilling operations cannot continue may be referred to as wait on cement ("WOC") time. Wait on cement is required to ensure proper zonal isolation in wellbores and mechanical support for the pipe string. Resuming drilling before the target compressive strength is reached may cause development of cracks within the cement sheath thereby potentially allowing fluid communication pathways to develop between the cement sheath and formation walls or within the cement sheath. Such fluid communication paths may negatively impact the wellbore integrity and may further require remediation through secondary cementing operations. Operators may design cement compositions that set relatively quickly after placement such that wait on cement time is minimized. However, challenges may exist pertaining to the rate of compressive strength development and ultimate compressive strength required to maintain wellbore integrity. In some examples, faster compressive strength development reduces the time the cement remains in a liquid, pumpable state, in which it can be placed in the annulus hydraulically. In some scenarios, the required cement properties not achievable with certain cement compositions. This may prevent the use of cement compositions which may otherwise have desirable properties such as the reducing the WOC time.

BRIEF DESCRIPTION OF THE DRAWINGS

These drawings illustrate certain aspects of some of the embodiments of the present method and should not be used to limit or define the present disclosure.

DETAILED DESCRIPTION

Figure 1:
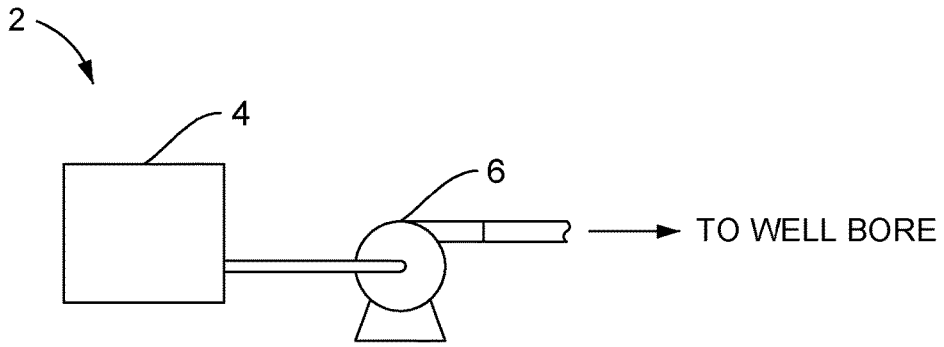
FIG. 1 illustrates a system for the preparation and delivery of a cement slurry to a wellbore in accordance with some embodiments of the present disclosure.

Disclosed herein are methods and systems for activating a cement slurry in an annulus formed between a casing and a wellbore. The method of activating the cement slurry causes the cement to have increased early compressive strength development, greater final compressive strength, quicker set time, and may increase set cement density. The cement slurry is set in the annulus thereby supporting the casing and wellbore. By selectively controlling the setting of a cement slurry, the described systems allow cement properties to be tailored once the cement slurry has been pumped into the wellbore. Disclosed herein are examples, which may relate to subterranean cementing operations and the application of ultrasonic devices to reduce the time required for cement to harden.

The methods of ultrasonic devices described herein may generally include disposing an ultrasonic device in a wellbore to emit ultrasonic waves which contact and at least partially permeate a cement slurry. For example, the described systems and methods may use sonic irradiation to accelerate the setting speed of cement slurries. In some examples, the described systems may directly activate the cement slurry using one or more different mechanisms responsive to sonic signals. The one or more different mechanisms may include modifying chemical properties, releasing chemicals, modifying physical properties (e.g., particle size), updating operating conditions (e.g., pressure, temperature), and/or other mechanisms responsive to sonic signals. In these instances, the described systems may directly activate cement slurry using sonic signals.

In some examples, the sonic signals relayed into a cement slurry may result in acoustic cavitation of at least a portion cement slurry. Acoustic cavitation may include the formation, growth, and implosive collapse of bubbles in the cement slurry. In some examples, acoustic cavitation caused by the ultrasonic waves may function to break up agglomerations of particulates or reduce the size of individual particulates in the cement slurry. Without being limited by theory, de-agglomeration by acoustic cavitation may expose additional surface area on which reactions may occur which may further accelerate the rate at which the cement sets. In other examples, acoustic cavitation caused by the ultrasonic waves may increase the pressure and/or temperature within the cement slurry which may accelerate the cement setting process. For example, the ultrasonic waves may cause a temperature rise within the cement slurry of about 10° C. to about 50° C. Alternatively, from about 10° C. to about 25° C., about 25° C. to about 35° C., about 35° C. to about 50° C., or any ranges therebetween.

Acoustic cavitation may increase or improve the homogeneity of the cement slurry exposed to the sonic signals due to dispersion caused by vibrations within the cement slurry. In further examples, acoustic cavitation caused by the ultrasonic waves may result in the rupture of chemical components in the cement slurry which may accelerate the cement setting process. Acoustic cavitation may additionally reduce the time required for the cement slurry to hydrate which may accelerate the cement setting process. In some examples, exposing the cement slurry to the ultrasonic waves may allow for the cement composition to set to form a hardened mass in period in a range from 1 hour to 1 day. Alternatively, from a period ranging from 5 minutes to 1 hour, from 1 hour to 3 hours, 3 hours to 12 hours, or from 12 hours to 1 day, or any ranges therebetween. In further examples, exposing the cement slurries to the ultrasonic waves may reduce the setting times for cement slurries by about 15% to about 50% as compared to a cement slurry which was not exposed to ultrasonic waves. Alternatively, from about 15% to about 25%, from amount 25% to about 35%, from about 35% to about 50%, or any ranges therebetween.

The ultrasonic device may be placed in any location on, in, or near the wellbore which allow for the ultrasonic waves to be transmitted into the cement slurry. In some examples the ultrasonic device may be disposed in contact with wellbore equipment, wellbore fluids, components of the wellbore, devices disposed within the wellbore, or combinations thereof. Wellbore equipment may include equipment that is intended to be a permanent fixture in the wellbore structure, or non-permanent equipment that is used while constructing the wellbore. Wellbore fluids may include any fluid present in the wellbore at the time when the cement slurry is placed in the wellbore. Components of the wellbore may include components that are exposed at the surface of the wellbore or components that are disposed within in the subterranean formation. Some exemplary locations where the ultrasonic device may be placed include, without limitation, on a casing, on a collar, on a centralizer, on a packer, on a tool string, on a wireline, on an e-line, slickline, or combinations thereof. The ultrasonic tools may receive power by any means including batteries and/or being wired to a power source. In further examples, ultrasonic tools disposed within the subterranean portion of a wellbore may be wired or otherwise connected to a power supply where the power supply is not located in the wellbore. In some examples, the power supply may be located on a rig, on piece of cementing equipment, on a wellsite location, or on an offshore platform.

While exposed to the cement slurry, the ultrasonic tool may operate at any of one or more frequencies which result in acoustic cavitation in a targeted portion of the cement slurry. Without limitation, the ultrasonic tool may operate at a frequency from about 20 hertz ("Hz") to about 2 megahertz ("MHz"). For example, the ultrasonic tool may operate at a frequency ranging between any of and/or including any ultrasonic frequency from about 20 Hz to about 500 Hz, about 500 Hz to about 1 kHz, about 1 kHz to about 10 kHz, about 10 kHz to about 20 kHz, about 20 kHz to about 30 kHz, about 30 kHz to about 50 kHz, about 50 kHz to about 100 kHz, about 100 kHz to about 500 kHz, about 500 kHz to about 1 MHz, about 1 MHz to about 2 MHz, or any ranges therebetween. In further examples the ultrasonic tool may operate at one or more frequencies in a range from about 5 kHz to about 10 kHz, about 10 kHz to about 15 kHz, about 15 kHz to about 20 kHz, about 20 kHz to about 25 kHz, about 25 kHz to about 30 kHz, about 15 kHz to about 30 kHz, about 15 kHz to about 25 kHz, about 15 kHz to about 25 kHz, or any ranges therebetween.

The power required for acoustic cavitation to occur within the cement slurry may be dependent on the pressure of the target portion of the cement slurry. In some examples, the required power to achieve acoustic cavitation may increase as a function of the pressure in the target portion of the cement slurry. In further examples, the power required to achieve acoustic cavitation may increase as the depth of the target portion of the cement slurry increases. Without limitation, the ultrasonic tool may operate at a power from about 0.5 kilowatt ("kW") to about 20 kW. For example, the ultrasonic tool may operate with a power from about 0.5 kW to about 1 kW, about 1 kW to about 5 kW, about 5 kW to about 10 kW, about 10 kW to about 15 kW, about 15 kW to about 20 kW, or any ranges therebetween. In further examples, the ultrasonic tool may operate at a power from about 1 kW to about 5 kW, about 1 to about 10 kW, about 1 kW to about 15 kW, about 5 kW to about 15 kW, about 5 kW to about 20 kW, about 10 kW to about 20 kW, about 2 kW to about 6 kW, or any ranges therebetween.

The time required for the cement slurry to be exposed to the ultrasonic frequency signal may vary according to the pressure in the cement, the utilized power, and the utilized ultrasonic frequency. In some examples, a portion of cement slurry disposed in a wellbore can be exposed to the ultrasonic waves for a continuous period of about 5 seconds to about 15 minutes. In some examples these ultrasonic waves may be referred to as continuous ultrasonic waves. Alternatively, from about 5 seconds to about 1 minute, about 1 minute to about 5 minutes, about 5 minutes to about 15 minutes, or any ranges therebetween. In some examples the exposure time may be determined based on monitoring the temperature within the portion of the cement slurry that is exposed to the ultrasonic frequency signal. In other examples, the compressive strength development may be characterized by monitoring the travel time of an ultrasonic signal through the cement composition or cement slurry. In further examples, an initial travel time response of the ultrasonic signal may be measured for the cement slurry and compared or correlated against sub-sequent travel time measurements of the ultrasonic signal.

Ultrasonic devices may utilize any suitable method or methods of generating ultrasonic waves such as piezoelectric transducers and capacitive transducers, for example. The ultrasonic devices can include specific ultrasonic tools such as an ultrasonic horn. The ultrasonic devices may include a controller for adjusting the operating parameters such as frequency, amplitude, and power of the ultrasonic waves enabling the ultrasonic tool to be adjusted to work at different wellbore conditions.

In some examples, a portion of cement slurry disposed in a wellbore can be exposed to the ultrasonic waves for a continuous period of about 5 seconds to about 15 minutes. Alternatively, from about 5 seconds to about 1 minute, about 1 minute to about 5 minutes, about 5 minutes to about 15 minutes, or any ranges therebetween.

Cement slurries described herein may generally include a hydraulic cement and water. The cement slurries may further include one or more supplementary cementitious materials and functional admixtures. In some examples, a cement slurry may include a partially hydrated cement, a fully hydrated cement, a fully liquified cement, a partially liquified cement, a partially hardened cement, or any combination thereof. A variety of hydraulic cements may be utilized in accordance with the present disclosure, including, but not limited to, those comprising calcium, aluminum, silicon, oxygen, iron, and/or sulfur, which set and harden by reaction with water. Suitable hydraulic cements may include, but are not limited to, Portland cements, pozzolana cements, gypsum cements, high alumina content cements, silica cements, and any combination thereof. In certain examples, the hydraulic cement may include a Portland cement. In some examples, the Portland cements may include Portland cements that are classified as Classes A, B, C, H, G, K and L cements according to American Petroleum Institute, *API Specification for Materials and Testing for Well Cements*, API Specification 10A, Twenty-Fifth Ed., Addendum 2 (August 2022). In addition, hydraulic cements may include cements classified by American Society for Testing and Materials (ASTM) in C150 (Standard Specification for Portland Cement), C595 (Standard Specification for Blended Hydraulic Cement) or C1157 (Performance Specification for Hydraulic Cements) such as those cements classified as ASTM Type I, IS, IP, IL. IT, II, or III.

The hydraulic cement may be included in the cement slurry in any amount suitable for a particular composition. Without limitation, the hydraulic cement may be included in the cement slurry in an amount in the range of from about 10% to about 80% by weight of the cement slurry. For example, the hydraulic cement may be present in an amount ranging between any of and/or including any of about 10%, about 15%, about 20%, about 25%, about 30%, about 35%, about 40%, about 45%, about 50%, about 55%, about 60%, about 65%, about 70%, about 75%, or about 80% by weight of the cement slurry. In some examples, the cement slurry may be considered a "low-Portland" cement where a Portland cement is present in an amount of 50% of less by weight of the cement slurry. For example, the composition may include one or more hydraulic cements such as Portland cement in an amount of 50% or less by weight and the balance comprising one or more supplementary cementitious materials such as pozzolanic materials or inert materials including, but not limited to slag, fly ash, natural glasses, silica fume, diatomaceous earth, weighting materials, calcium carbonates, bio ashes, calcined clays, clays, shales, zeolites, and combinations thereof.

The water included in the cement slurry may be from any source provided that it does not contain an excess of compounds that may undesirably affect other components in the hardened cement composition or cement slurry. For example, a cement slurry may include fresh water or saltwater. Saltwater generally may include one or more dissolved salts therein and may be saturated or unsaturated as desired for a particular application. Seawater or brines may be suitable for use in some examples. Further, the water may be present in an amount sufficient to form a pumpable slurry. In certain examples, the water may be present in the cement slurry in an amount in the range of from about 33% to about 200% by weight of the cement slurry. For example, the water may be present in an amount ranging between any of and/or including any of about 33%, about 50%, about 75%, about 100%, about 125%, about 150%, about 175%, or about 200% by weight of the cement slurry.

As mentioned above, the cement slurry may include supplementary cementitious materials. The supplementary cementitious material may be any material that contributes to the compressive strength of the cement composition, for example. In some examples, the cement slurry may include a variety of fly ashes as a supplementary cementitious material which may include fly ash classified as Class C, Class F, or Class N fly ash according to American Petroleum Institute, API Specification for Materials and Testing for Well Cements, API Specification 10, Fifth Ed., Jul. 1, 1990.

In some examples, the cement slurry may further include zeolites as supplementary cementitious materials. Zeolites are generally porous alumino-silicate minerals that may be either natural or synthetic. Synthetic zeolites are based on the same type of structural cell as natural zeolites and may comprise aluminosilicate hydrates. As used herein, the term "zeolite" refers to all natural and synthetic forms of zeolite.

The cement slurry may include kiln dust as a supplementary cementitious material. "Kiln dust," as that term is used herein, refers to a solid material generated as a by-product of the heating of certain materials in kilns. The term "kiln dust" as used herein is intended to include kiln dust made as described herein and equivalent forms of kiln dust. Depending on its source, kiln dust may exhibit cementitious properties in that it can set and harden in the presence of water. Examples of suitable kiln dusts include cement kiln dust, lime kiln dust, and combinations thereof. Cement kiln dust may be generated as a by-product of cement production that is removed from the gas stream and collected, for example, in a dust collector. Usually, large quantities of cement kiln dust are collected in the production of cement that are commonly disposed of as waste. The chemical analysis of the cement kiln dust from various cement manufactures varies depending on several factors, including the particular kiln feed, the efficiencies of the cement production operation, and the associated dust collection systems. Cement kiln dust generally may include a variety of oxides, such as $SiO_2$, $Al_2O_3$, $Fe_2O_3$, CaO, MgO, $SO_3$, $Na_2O$, and $K_2O$. The chemical analysis of lime kiln dust from various lime manufacturers varies depending on several factors, including the particular limestone or dolomitic limestone feed, the type of kiln, the mode of operation of the kiln, the efficiencies of the lime production operation, and the associated dust collection systems. Lime kiln dust generally may include varying amounts of free lime and free magnesium, limestone, and/or dolomitic limestone and a variety of oxides, such as $SiO_2$, $Al_2O_3$, $Fe_2O_3$, CaO, MgO, $SO_3$, $Na_2O$, and $K_2O$, and other components, such as chlorides. Cement kiln dust may include a partially calcined kiln feed which is removed from the gas stream and collected in a dust collector during the manufacture of cement. The chemical analysis of CKD from various cement manufactures varies depending on several factors, including the particular kiln feed, the efficiencies of the cement production operation, and the associated dust filter systems.

In some examples, the cement slurry may further include one or more of perlite, natural glass, shale, amorphous silica, slag or metakaolin as a supplementary cementitious material. Slag is generally a granulated, blast furnace by-product from the production of cast iron or steel making including the oxidized impurities found in iron ore. Natural glasses may include mineral species which are amorphous glasses such as volcanic rock, for example. The cement may further include perlite. Perlite is an ore and generally refers to a naturally occurring volcanic, amorphous siliceous rock including mostly silicon dioxide and aluminum oxide. The perlite may be expanded and/or unexpanded as suitable for a particular application. The expanded or unexpanded perlite may also be ground, for example. The cement may further include shale. A variety of shales may be suitable, including those including silicon, aluminum, calcium, and/or magnesium. Examples of suitable shales include vitrified shale and/or calcined shale. In some examples, the cement slurry may further include amorphous silica as a supplementary cementitious material. Amorphous silica is a powder that may be included in embodiments to increase cement compressive strength. Amorphous silica is generally a byproduct of a ferrosilicon production process, wherein the amorphous silica may be formed by oxidation and condensation of gaseous silicon suboxide, SiO, which is formed as an intermediate during the process. Metakaolin may be an anhydrous calcined form of the clay mineral kaolinite.

Where used, one or more of the aforementioned supplementary cementitious materials may be present in the cement slurry. For example, without limitation, one or more supplementary cementitious materials may be present in an amount of about 0.1% to about 80% by weight of the cement slurry. For example, the any of the aforementioned supplementary cementitious materials may be present in an amount ranging between any of and/or including any of about 10%, about 15%, about 20%, about 25%, about 30%, about 35%, about 40%, about 45%, about 50%, about 55%, about 60%, about 65%, about 70%, about 75%, or about 80% by weight of the cement slurry.

In some examples, the cement slurry may further include hydrated lime. As used herein, the term "hydrated lime" will be understood to mean calcium hydroxide. In some embodiments, the hydrated lime may be provided as quicklime (calcium oxide) which hydrates when mixed with water to form the hydrated lime. The hydrated lime may be included in examples of the cement slurry, for example, to form a hydraulic composition with one or more supplementary cementitious materials. For example, the hydrated lime may be included in a supplementary cementitious material-to-hydrated-lime weight ratio of about 10:1 to about 1:1 or 3:1 to about 5:1. Where present, the hydrated lime may be included in the cement slurry in an amount in the range of from about 10% to about 100% by weight of the cement composition, for example. In some examples, the hydrated lime may be present in an amount ranging between any of and/or including any of about 10%, about 20%, about 40%, about 60%, about 80%, or about 100% by weight of the cement composition.

Other additives suitable for use in subterranean cementing operations also may be included in embodiments of the cement slurry. Examples of such additives include, but are not limited to weighting agents, lightweight additives, gas-generating additives, mechanical-property-enhancing additives, lost-circulation materials, filtration-control additives, fluid-loss-control additives, defoaming agents, foaming agents, thixotropic additives, and combinations thereof. In some examples, the cement composition may further include a dispersant. Examples of suitable dispersants include, without limitation, sulfonated-formaldehyde-based dispersants (e.g., sulfonated acetone formaldehyde condensate) or polycarboxylated ether dispersants. In some examples, the dispersant may be included in the cement slurry in an amount in the range of from about 0.01% to about 5% by weight of the cement slurry. In specific examples, the dispersant may be present in an amount ranging between any of and/or including any of about 0.01%, about 0.1%, about 0.5%, about 1%, about 2%, about 3%, about 4%, or about 5% by weight of the cement slurry.

In some examples, the cement slurry may further include a set retarder. A broad variety of set retarders may be suitable for use in the cement slurry. For example, the set retarder may comprise phosphonic acids, such as ethylenediamine tetra(methylene phosphonic acid), diethylenetriamine penta (methylene phosphonic acid), etc.; lignosulfonates, such as sodium lignosulfonate, calcium lignosulfonate, etc.; salts such as stannous sulfate, lead acetate, monobasic calcium phosphate, organic acids, such as citric acid, tartaric acid, etc.; cellulose derivatives such as hydroxyl ethyl cellulose (HEC) and carboxymethyl hydroxyethyl cellulose (CMHEC); synthetic co- or ter-polymers comprising sulfonate and carboxylic acid groups such as sulfonate-functionalized acrylamide-acrylic acid co-polymers; borate compounds such as alkali borates, sodium metaborate, sodium tetraborate, potassium pentaborate; derivatives thereof, or mixtures thereof. Examples of suitable set retarders include, among others, phosphonic acid derivatives. Generally, the set retarder may be present in the cement composition in an amount sufficient to delay the setting for a desired time. In some examples, the set retarder may be present in the cement slurry in an amount in the range of from about 0.01% to about 10% by weight of the cement slurry. In specific examples, the set retarder may be present in an amount ranging between any of and/or including any of about 0.01%, about 0.1%, about 1%, about 2%, about 4%, about 6%, about 8%, or about 10% by weight of the cement slurry.

The cement composition may have a density in the range of from about 4 pounds per gallon ("lbm/gal") or about 1677.6 kilograms per cubic meter ("$kg/m^3$") to about 20 lbm/gal (2369.5 $kg/m^3$). In certain embodiments, the cement composition may have a density in the range of from about 8 lbm/gal (958.6 $kg/m^3$) to about 17 lbm/gal (2037 $kg/m^3$) or about 8 lbm/gal (958.6 $kg/m^3$) to about 14 lbm/gal (1677.6 $kg/m^3$). Examples of the cement compositions may be foamed or unfoamed or may comprise other means to reduce their densities, such as hollow microspheres, low-density elastic beads, or other density-reducing additives known in the art. In examples, the density of the cement composition may be reduced prior to placement in a subterranean formation.

The cement slurries may set to have a compressive strength after activation. For example the cement may set to have a compressive strength in a range of from about 500 pounds per square inch ("psi") or about 3.4 Megapascal ("MPa") to about 10,000 psi (69 MPa). Alternatively, from about 500 psi (3.4 MPa) to about 1,000 psi (6.9 MPa), about 1,000 psi (6.9 MPa) to about 5,000 psi (34.6 MPa), about 5,000 psi (34.6 MPa) to about 10,000 psi (69 MPa), or any ranges therebetween. Compressive strength is generally the capacity of a material or structure to withstand axially directed pushing forces. The compressive strength may be measured at a specified time after the cement composition has been mixed and the resultant composition is maintained under specified temperature and pressure conditions. Compressive strength can be measured by either destructive or non-destructive methods. The destructive method physically tests the strength of treatment fluid samples at various points in time by crushing the samples in a compression-testing machine. The compressive strength is calculated from the failure load divided by the cross-sectional area resisting the load and is reported in units of pound-force per square inch (psi). Non-destructive methods may employ a UCA ultrasonic cement analyzer. Compressive strength values may be determined in accordance with API RP 10B-2 "Testing Well Cements" in the current edition.

Referring now to FIG. 1, the preparation of a cement slurry in accordance with example embodiments will now be described. FIG. 1 illustrates a system 2 for the preparation of a cement slurry and subsequent delivery of the composition to a wellbore in accordance with certain embodiments. The cement slurry may be prepared according to any method disclosed herein. As shown, the cement slurry may be mixed in mixing equipment 4, such as a jet mixer, re-circulating mixer, or a batch mixer, for example, and then pumped via pumping equipment 6 to the wellbore. In some embodiments, the mixing equipment 4 and the pumping equipment 6 may be disposed on one or more cement trucks. In some embodiments, a jet mixer may be used, for example, to continuously mix cement components with the water as it is being pumped to the wellbore. In embodiments, a re-circulating mixer and/or a batch mixer may be used to mix the cement composition and cement additives.

Figure 2:
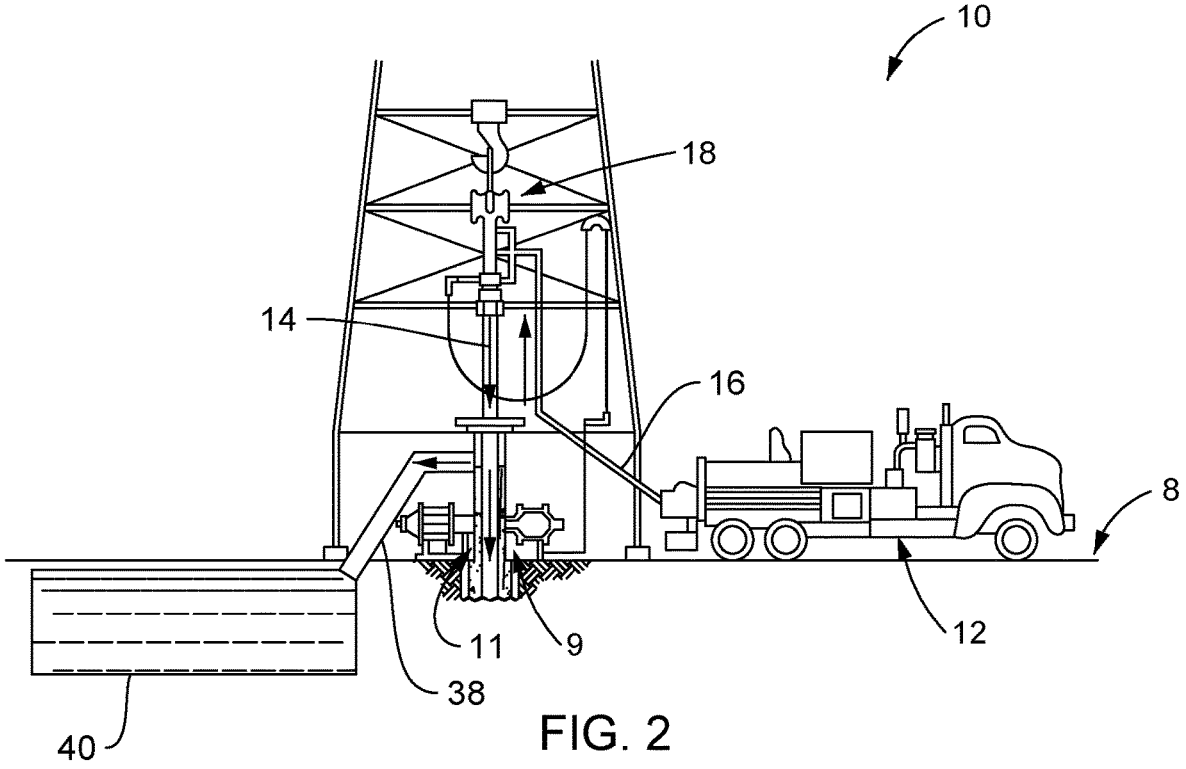
FIG. 2 illustrates surface equipment that may be used in the placement of a cement slurry in a wellbore in accordance with some embodiments of the present disclosure.

An example technique for placing a cement slurry into a subterranean formation will now be described with reference to FIGS. 2 and 3. FIG. 2 illustrates surface equipment 10 that may be used in placement of a cement slurry in accordance with certain embodiments. It should be noted that while FIG. 2 generally depicts a land-based operation, the principles described herein are equally applicable to subsea operations that employ floating or sea-based platforms and rigs, without departing from the scope of the disclosure. As illustrated by FIG. 2, the surface equipment 10 may include a cementing unit 12, which may include one or more cement trucks located on a wellsite location 8. In some examples, wellsite location 8 may be referred to as a surface location. A wellhead 11 may be located at the wellbore surface 9 where the wellbore intersects surface location 8. The cementing unit 12 may include mixing equipment 4 and pumping equipment 6 (e.g., FIG. 1). The cementing unit 12 may pump a cement slurry 14 through a feed pipe 16 to a cementing head 18 which may convey the cement slurry 14 downhole. In some examples, cementing head 18 may contain a wiper plug or a pump down tool (not shown) which may be released into the flow conduit entering the wellbore to trail behind cement slurry 14.

Figure 3:
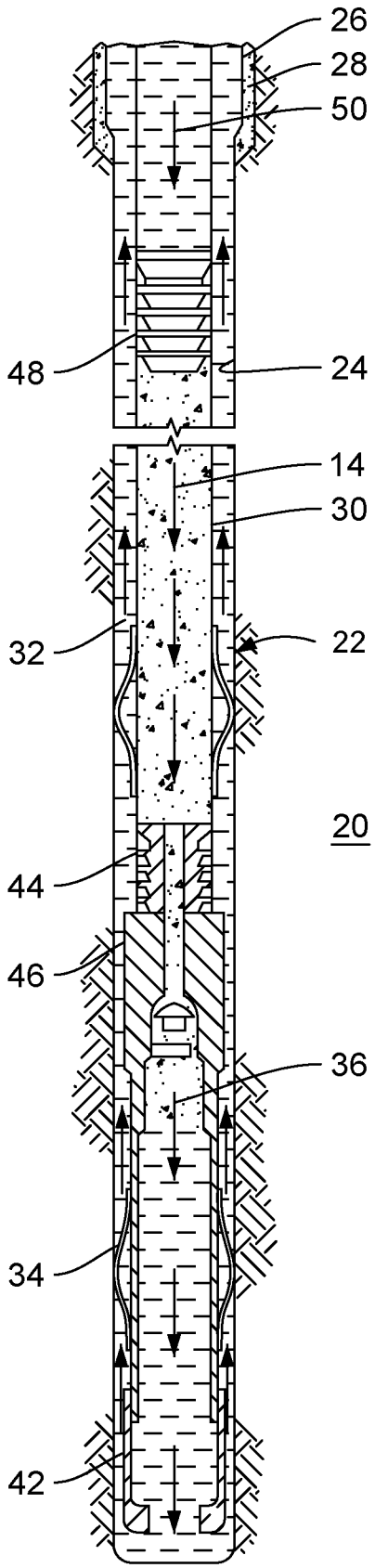
FIG. 3 illustrates the placement of a cement slurry into a wellbore annulus in accordance with some embodiments of the present disclosure.

Turning now to FIG. 3, the cement slurry 14 may be placed into a subterranean formation 20 in accordance with example embodiments. As illustrated, a wellbore 22 may be drilled into the subterranean formation 20. While wellbore 22 is shown extending generally vertically into the subterranean formation 20, the principles described herein are also applicable to wellbores that extend at an angle through the subterranean formation 20, such as horizontal and slanted wellbores. The wellbore walls 24 may be the interface between subterranean formation 20 and wellbore 22. In the illustrated embodiment, a surface casing 26 has been inserted into the wellbore 22. An annular space 28 is created between surface casing 26 and wellbore walls of formation 20. Surface casing 26 may be cemented to the wellbore walls of formation 20 by pumping cement slurry 14 down the inside of surface casing 26 and allowing cement slurry 14 to move into annular space 28. Once cement slurry 14 is placed in annular space 28, it may harden into a cement sheath. In the illustrated example, one or more additional conduits (e.g., intermediate casing, production casing, liners, etc.), shown here as casing 30 may also be disposed in wellbore 22. As illustrated, there may be a wellbore annulus 32 formed between casing 30 and wellbore walls 24 of wellbore 22 and/or surface casing 26. One or more casing centralizers 34 may be attached to casing 30, for example, to centralize casing 30 in wellbore 22 prior to and during the cementing operation. In some examples, casing centralizers may be hard bodied centralizers, bow spring centralizers, or a combination thereof. In some examples, a casing such as surface casing 26 or casing 30 may be disposed on a work string (not shown here) and conveyed into a wellbore.

With continued reference to FIG. 3, cement slurry 14 may be pumped down the interior of casing 30. Cement slurry 14 may be allowed to flow down the interior of casing 30 through the casing shoe 42 at the bottom of casing 30 and up around the outer diameter of casing 30 into wellbore annulus 32. Cement slurry 14 may be allowed to set in wellbore annulus 32, for example, to form a cement sheath that supports and positions the casing 30 in the wellbore 22. While not illustrated, other techniques may also be utilized for introduction of cement slurry 14. By way of example, reverse circulation techniques may be used that include introducing cement slurry 14 into subterranean formation 20 by way of wellbore annulus 32 instead of through the flow conduit crated through the inner diameter of casing 30.

As it is introduced into wellbore 22, cement slurry 14 may displace other fluids 36, such as drilling fluids and/or spacer fluids that may be present in the interior of casing 30 and/or wellbore annulus 32. At least a portion of displaced fluids 36 may exit wellbore annulus 32 via a flow line 38 and be deposited, for example, in one or more retention pits 40 (e.g., a mud pit), as shown on FIG. 2. Referring again to FIG. 3, a bottom plug 44 may be introduced into wellbore 22 ahead of cement slurry 14. In some examples bottom plug 44 may isolate cement slurry 14 from displaced fluids 36 that may be inside casing 30 prior to cementing. In other examples, a spacer fluid (not shown) may be pumped ahead of cement slurry 14. In some examples bottom plug 44 may be used with a spacer fluid to prevent cement slurry 14 from contacting displaced fluids 36. After bottom plug 44 reaches the landing collar 46, a diaphragm, a rupture disc, or other suitable device within bottom plug 44 may rupture to create a conduit through which cement composition 14 may pass before entering wellbore annulus 32. In FIG. 3, bottom plug 44 is shown on the landing collar 46. In the illustrated embodiment, a top plug 48 may be introduced into the wellbore 22 behind cement slurry 14. Top plug 48 may separate cement slurry 14 from a displacement fluid 50 and push cement slurry 14 through the bottom plug 44.

Figure 4:
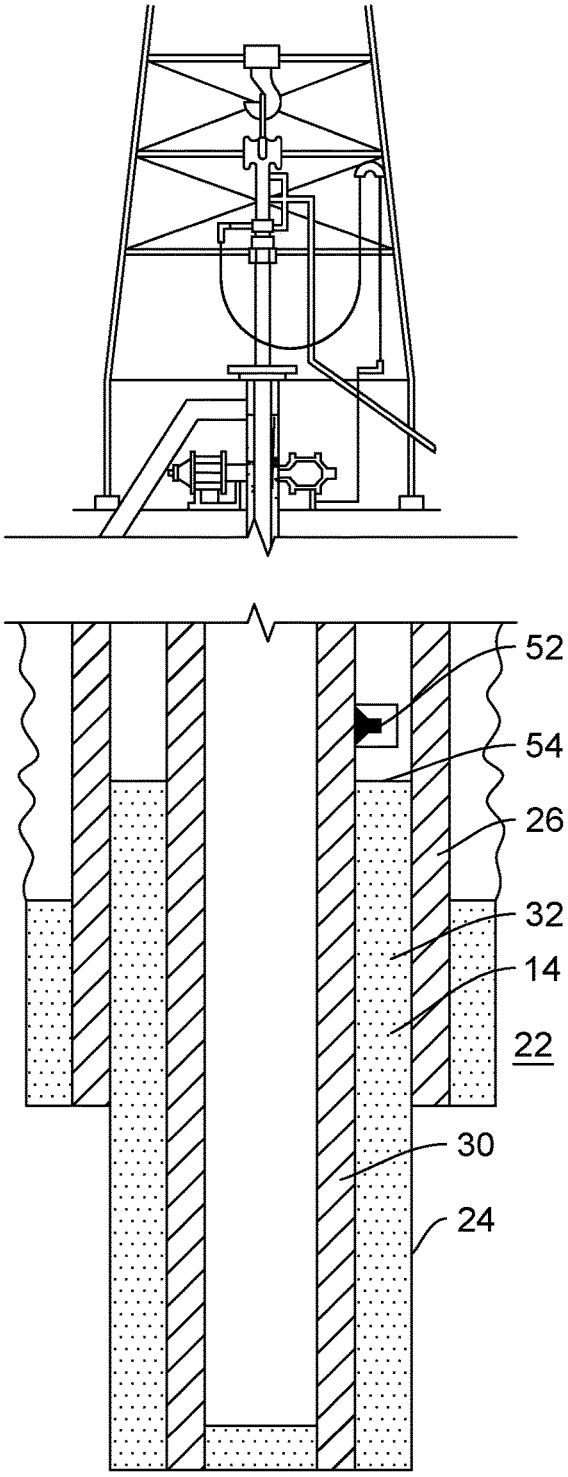
FIG. 4 illustrates an example configuration for utilizing an ultrasonic device in accordance with some embodiments of the present disclosure.

As detailed in the foregoing, ultrasonic devices may be disposed in a wellbore to emit ultrasonic waves which contact and at least partially permeate a cement slurry such as cement slurry 14. The ultrasonic waves can help to harden cement slurry 14 and form a cement sheath. FIG. 4 illustrates an example configuration for utilizing an ultrasonic device in accordance some embodiments of the present disclosure. In FIG. 4, an ultrasonic tool 52 is disposed within wellbore annulus 32 such that ultrasonic tool 52 may be in contact with casing 30. Ultrasonic tool 52 may receive power by any means. In some examples ultrasonic tool 52 may be battery powered while in other examples, ultrasonic tool 52 may be wired back to the surface of the well and connected to a power supply on the wellsite location. In other examples ultrasonic tool may receive power. As shown in FIG. 4, ultrasonic tool 52 is disposed in wellbore annulus 32 which contains cement slurry 14. The ultrasonic waves from ultrasonic tool 52 may travel along casing 30 to reach cement slurry 14. The depth at which ultrasonic tool 52 is located in wellbore annulus 32 may depend on the location of the top of cement ("TOC") 54. Ultrasonic tool 52 may be disposed in wellbore annulus 32 at the wellbore surface (e.g.: wellbore surface 9 as in FIG. 2) or at some depth between the wellbore surface and TOC 54.

Figure 5:
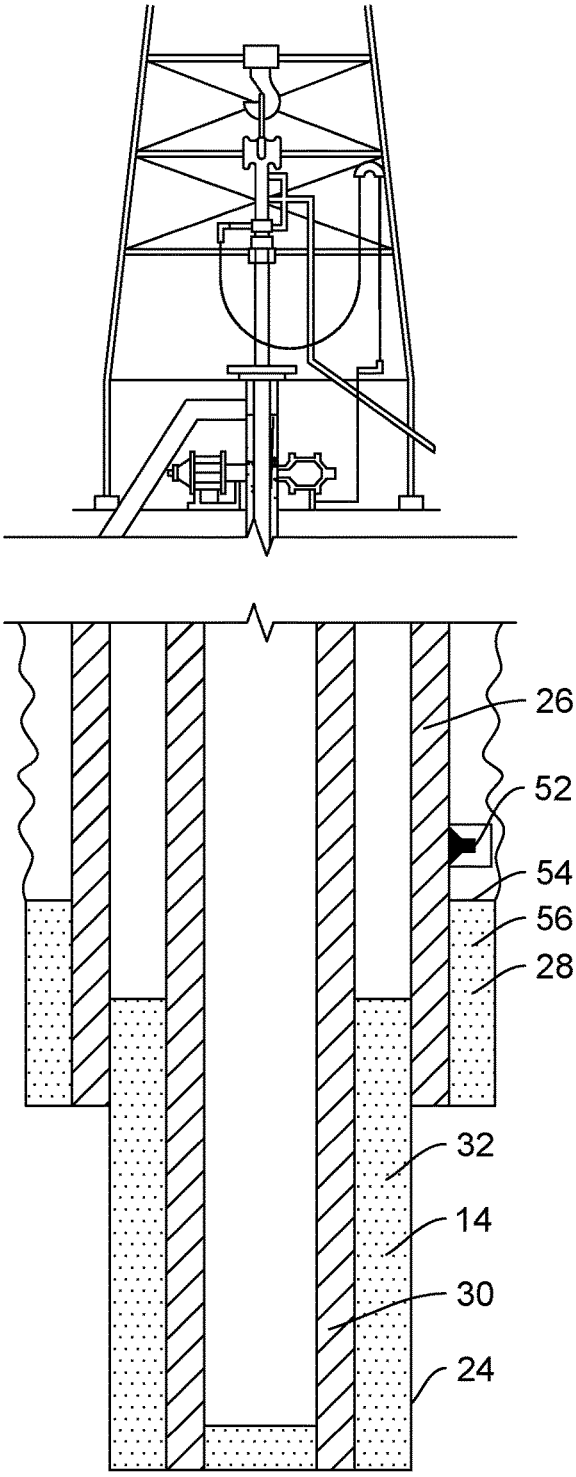
FIG. 5 illustrates an additional example configuration for utilizing an ultrasonic device in accordance with some embodiments of the present disclosure.

FIG. 5 illustrates an example configuration for utilizing an ultrasonic device in accordance some embodiments of the present disclosure. In FIG. 5, ultrasonic tool 52 is disposed in the annular space of a preceding casing string where the cement slurry has already formed a cement sheath. FIG. 5 depicts ultrasonic tool 52 disposed in the annular space 56 of casing string 26. As depicted, casing string 26 is cemented in place with cement sheath 28. Ultrasonic tool 52 is placed in contact with casing string 26 in order to relay or emit ultrasonic waves through casing string 26 and into cement slurry 14. Ultrasonic tool 52 may be disposed in annular space 56 at the wellbore surface (e.g.: wellbore surface 9 in FIG. 2) or at some depth between the wellbore surface and TOC 54. In some examples ultrasonic tool 52 may be battery powered while in other examples, ultrasonic tool 52 may be wired back to the surface of the well and connected to a power supply on the wellsite location.

Figure 6B:
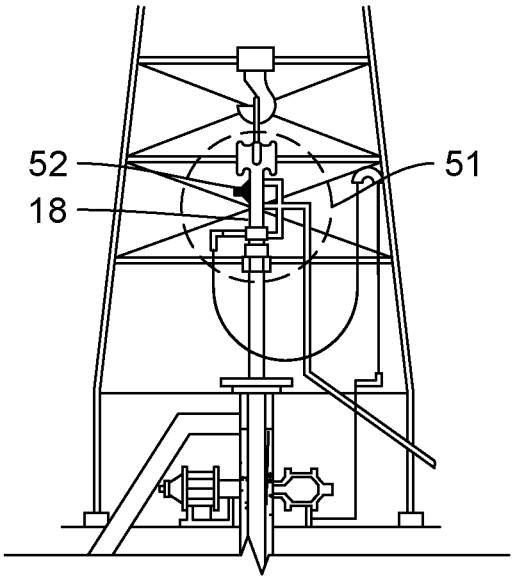
FIG. 6B is a close-up view of a portion of the cementing equipment in FIG. 6A.
Figure 6B:
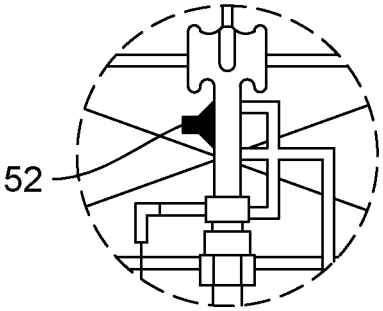
Figure 6A:
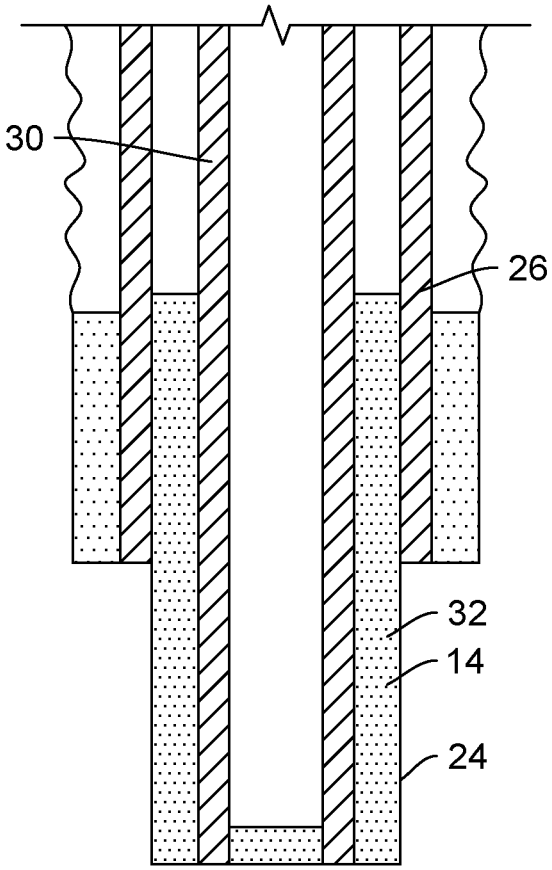
FIG. 6A illustrates an additional example configuration for utilizing an ultrasonic device in accordance with some embodiments of the present disclosure.

FIG. 6A illustrates an example configuration for utilizing an ultrasonic device in accordance some embodiments of the present disclosure. FIG. 6B illustrates a close-up view of a portion of the cementing equipment as indicated by the dashed circle 51 in FIG. 6A. Specifically, FIG. 6B includes a close-up view of cementing head 18. In FIGS. 6A and 6B, ultrasonic tool 52 is connected to a piece of surface equipment that is in physical contact with the wellbore casing. FIGS. 6A and 6B depict ultrasonic tool 52 connected to cementing head 18 which is further connected to casing 30. As depicted, casing 30 is disposed within surface casing 26, however it should be noted that casing 30 could be disposed within any of one or more casing strings which constitute a nested set of casing strings. Furthermore, an additional casing string may be disposed in casing 30 in the event that additional drilling takes place. Wellbore annulus 32 is created between casing 30 and surface casing 26 as well as between casing 30 and wellbore wall 24. Cement slurry 14 may be disposed in wellbore annulus 32. The ultrasonic waves from ultrasonic tool 52 are relayed through cementing head 18 and casing 30 and into cement slurry 14. In some examples, ultrasonic tool 52 may be connected to the wellhead (e.g.: wellhead 11 in FIG. 2). In some examples ultrasonic tool 52 may be battery powered while in other examples, ultrasonic tool 52 may be wired to receive power from a power source on the wellsite location.

Figure 7:
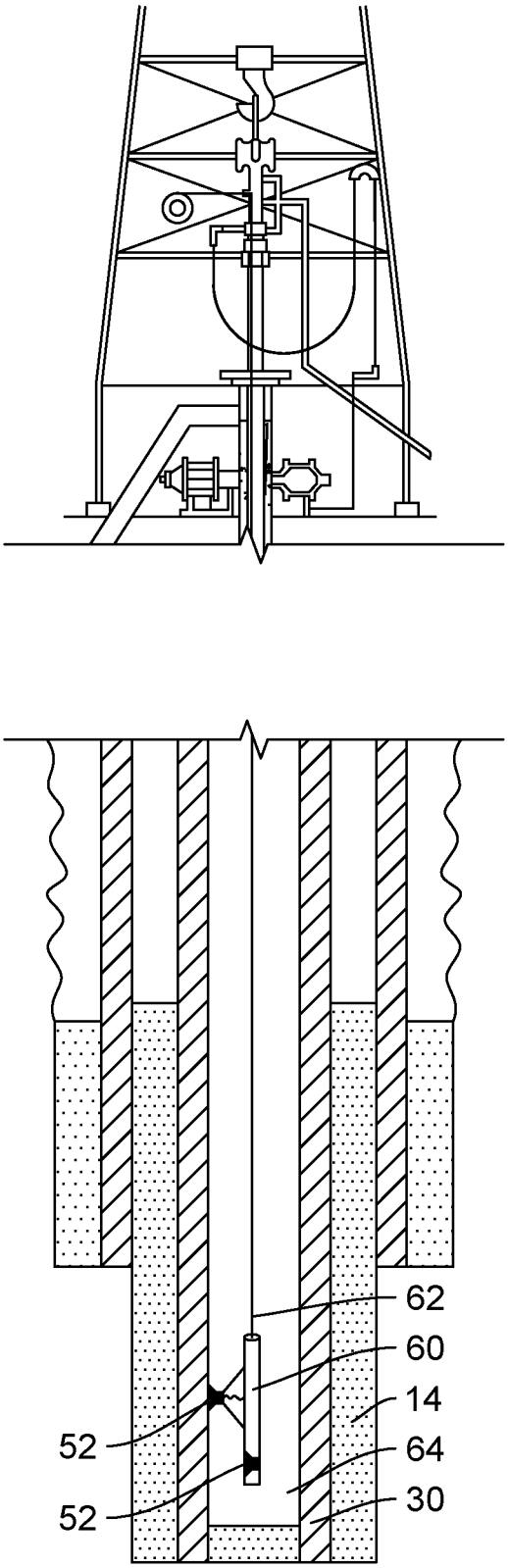
FIG. 7 illustrates an additional example configuration for utilizing an ultrasonic device in accordance with some embodiments of the present disclosure.

FIG. 7 illustrates an example configuration for utilizing an ultrasonic device in accordance some embodiments of the present disclosure. As depicted in FIG. 7, ultrasonic tool 52 is disposed on a logging tool 60 and relayed in wellbore 22 using a conveyance 62 such as wireline, electric line, or slick line. Logging tool 60 may be placed in contact with casing 30 to allow the ultrasonic waves from ultrasonic tool 52 to travel through casing 30 and into cement slurry 14. In some examples, the ultrasonic waves from ultrasonic tool 52 may travel through a wellbore fluid 64 before travelling through casing 30 and into cement slurry 14. In further examples, more than one ultrasonic tool 52 may be disposed on logging tool 60. This may allow for one or more ultrasonic tools 52 to be in contact with casing 30, while other ultrasonic tools may relay ultrasonic waves through wellbore fluid 64. In some examples ultrasonic tool 52 may generate ultrasonic waves at one or more depths within wellbore 22. In some examples ultrasonic tool 52 may be battery powered while in other examples, ultrasonic tool 52 may be wired back to the surface of the well through the wireline and connected to a power supply on the wellsite location.

Figure 8:
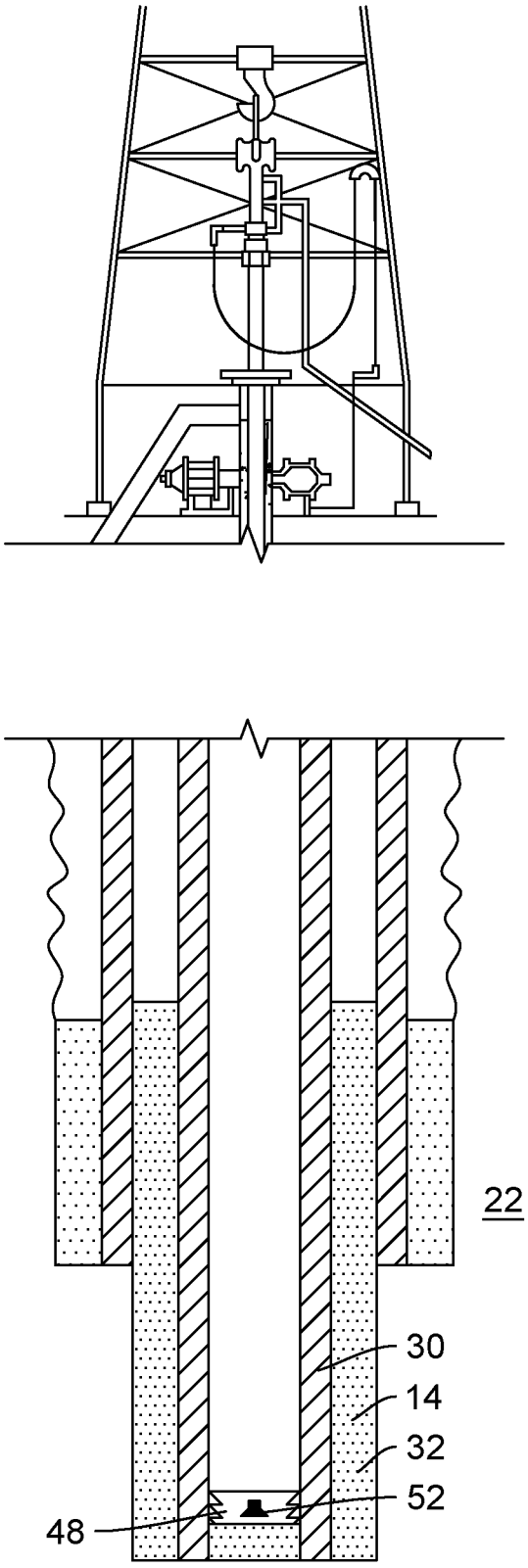
FIG. 8 illustrates an additional example configuration for utilizing an ultrasonic device in accordance with some embodiments of the present disclosure.

FIG. 8 illustrates an example configuration for utilizing an ultrasonic device in accordance some embodiments of the present disclosure. FIG. 8 depicts ultrasonic tool 52 which is disposed within top plug 48. As previously mentioned, top plug 48 may be released from the cementing head (e.g.: cementing head 18 from FIG. 2) to be pumped down behind cement slurry 14. In some examples, top plug 48 may be referred to as a "wiper plug," or a "wiper dart," and may have fins attached perpendicular to the length of the plug which may wipe cement from the inner diameter of the casing to allow the cement to progress with cement slurry 14. Once top plug 48 is pumped to the bottom of wellbore 22 it may seat on the bottom plug (e.g.: bottom plug 44 in FIG. 3) at which point cement slurry 14 will have progressed past the casing shoe (e.g.: casing shoe 42 from FIG. 3) and into wellbore annulus 32. A pressure increase may be seen at the wellbore surface (e.g.: wellbore surface 9 in FIG. 2) when top plug 48 seats on the bottom plug. Ultrasonic tool 52 disposed in top plug 48 may begin emitting ultrasonic waves at any time during the cementing job. In some examples, ultrasonic tool 52 disposed in top plug 48 may begin emitting ultrasonic waves once it is released from the cementing head (e.g.: cementing head 18 from FIG. 2). In other examples, ultrasonic tool 52 disposed in top plug 48 may begin emitting ultrasonic waves once it seats on the bottom plug (e.g.: bottom plug 44 in FIG. 3). In some examples ultrasonic tool 52 may be battery powered. Once cement slurry 14 has hardened to form a cement sheath, standard drilling operations may be used to drill-out or mill-out top plug 48 and the bottom plug along with the casing shoe before extending the wellbore further into the subterranean formation (e.g.: subterranean formation 20 in FIG. 3).

Figure 9:
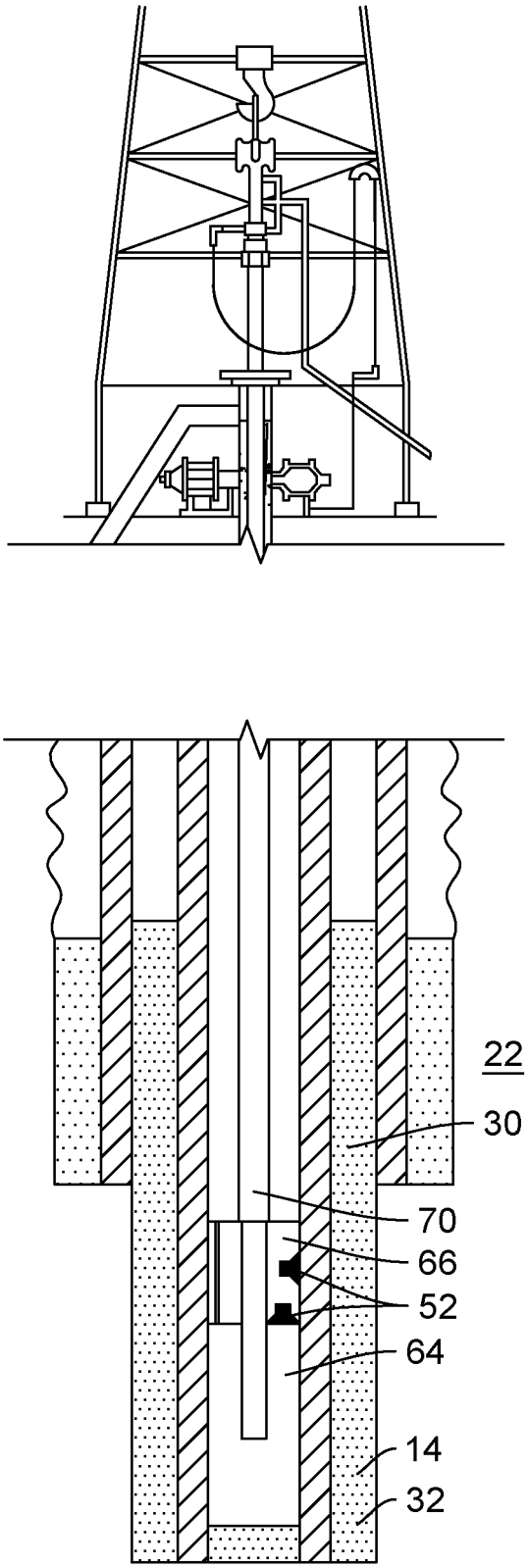
FIG. 9 illustrates an additional example configuration for utilizing an ultrasonic device in accordance with some embodiments of the present disclosure.

FIG. 9 illustrates an example configuration for utilizing an ultrasonic device in accordance some embodiments of the present disclosure. As depicted in FIG. 9, one or more ultrasonic tools 52 is disposed within a wellbore isolation tool 66 such as a packer or a bridge plug. Wellbore isolation tool 66 may not be fully isolating, but it may limit at least a portion of the flow path through the inner diameter of casing 30. While wellbore isolation tool 66 may be designed to be retrieved after usage, it may also be designed to be drilled out. In some examples, wellbore isolation tool 66 may be run in wellbore 22 using tubular running tool 70. Tubular running tool 70 may include any tubulars which may be disposed within wellbore 22. In some examples, tubular running tool 70 may include work strings, drill pipe, production tubulars, or coiled tubing. In other examples, wellbore isolation tool 66 may be run in the well using a conveyance (e.g.: conveyance 62 in FIG. 7) which may include wireline, electric line, or slick line. A portion of wellbore isolation tool 66 may be placed in contact with wellbore 22 such that the ultrasonic waves from ultrasonic tool 52 are relayed directly into casing 30. In other examples, wellbore isolation tool 66 may be positioned such that ultrasonic waves from ultrasonic tool 52 may be relayed through wellbore fluid 64. In some examples ultrasonic tool 52 may be battery powered while in other examples, ultrasonic tool 52 may be wired back to the surface of the well and connected to a power supply on the wellsite location.

Figure 10:
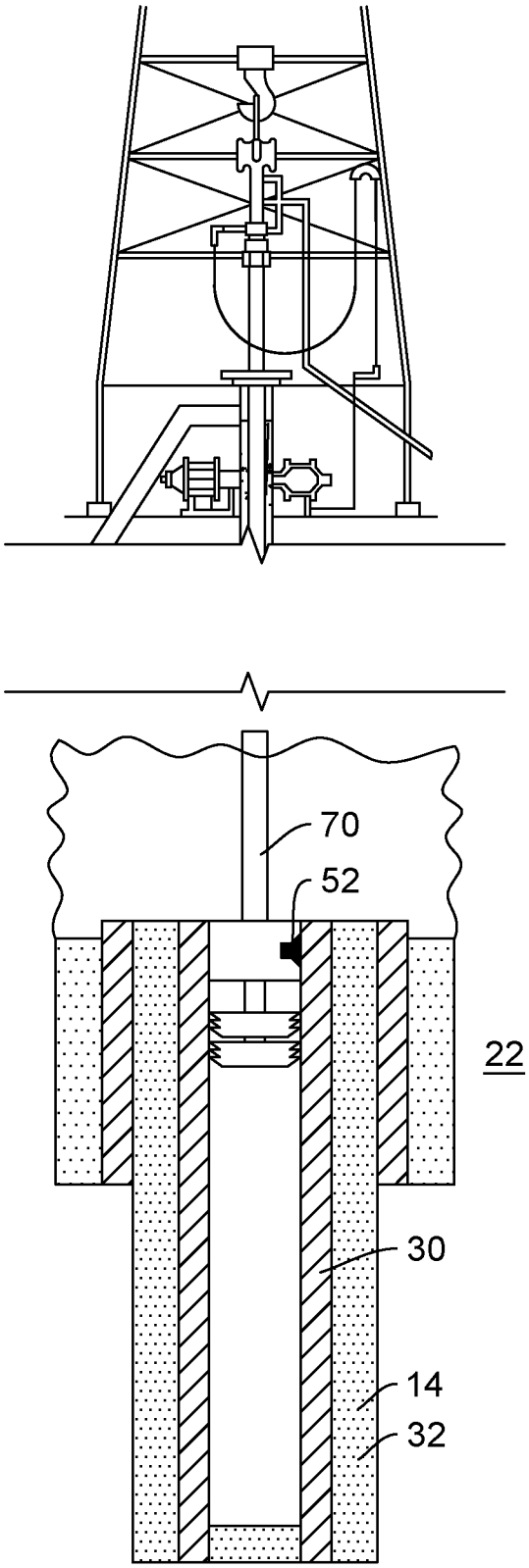
FIG. 10 illustrates an additional example configuration for utilizing an ultrasonic device in accordance with some embodiments of the present disclosure.

FIG. 10 illustrates an example configuration for utilizing an ultrasonic device in accordance some embodiments of the present disclosure. As depicted in FIG. 10, ultrasonic tool 52 is disposed within a tubular running tool 70 which may further be used to relay casing 30 into wellbore 22. In some examples, tubular running tool 70 may be used for offshore wells where there may be a distance between the rig floor and the seafloor. In other examples, tubular running tool 70 may be used in onshore applications to hang casing liners within wellbores. Casing liners may be casing strings which do not extend to the surface of wellbore 22. Rather, casing liners are "hung off," with packing elements within a vertical section of wellbore 22. After casing 30 is relayed into the well using tubular running tool 70, cement slurry 14 may be pumped down tubular running tool 70 and into wellbore annulus 32. Ultrasonic tool 52 may be turned on at any time during or after pumping and placing cement slurry 14 in wellbore annulus 32. In some examples ultrasonic tool 52 may be battery powered while in other examples, ultrasonic tool 52 may be wired back to the surface of the well and connected to a power supply on the rig, offshore platform, or wellsite location.

Figure 11:
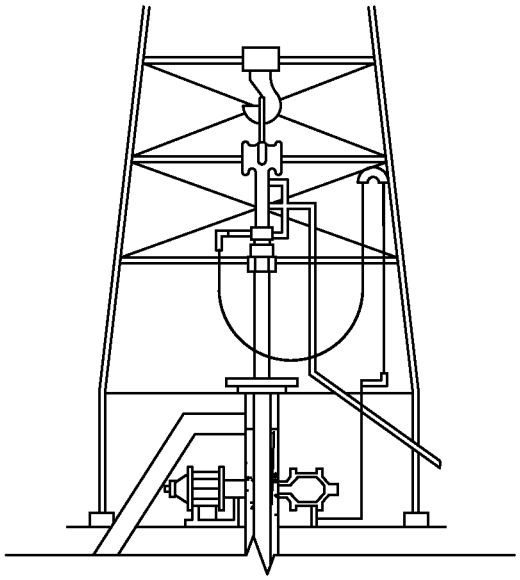
FIG. 11 illustrates an additional example configuration for utilizing an ultrasonic device in accordance with some embodiments of the present disclosure.
Figure 11:
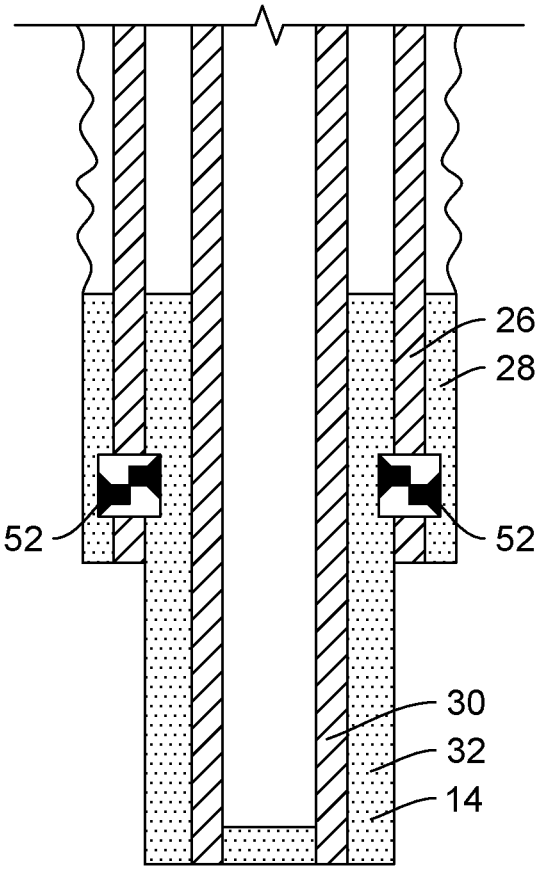

FIG. 11 illustrates an example configuration for utilizing an ultrasonic device in accordance some embodiments of the present disclosure. As depicted in FIG. 11, one or more ultrasonic tools 52 may be disposed within or on any casing string. Although multiple ultrasonic tools 52 are displayed in FIG. 11, in some examples there may be only one ultrasonic tool 52 disposed in a casing string. Ultrasonic tool 52 may be disposed within surface casing 26 or casing 30 as a permanent component of wellbore 22. In other examples, ultrasonic tool 52 may be disposed in or on a casing centralizer which is further disposed on a casing string such as surface casing 26 or casing 30. In further examples, ultrasonic tool 52 may be utilized for any cementing job that occurs after ultrasonic tool 52 is disposed within wellbore 22 including cementing jobs associated with subsequent casing strings disposed in wellbore 22. In some examples ultrasonic tool 52 may be battery powered while in other examples, ultrasonic tool 52 may be wired back to the surface of the well and connected to a power supply on the rig, offshore platform, or wellsite location.

Figure 12:
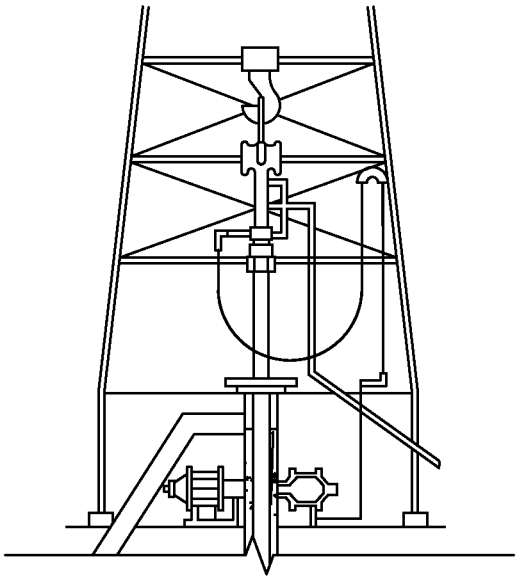
FIG. 12 illustrates an additional example configuration for utilizing an ultrasonic device in accordance with some embodiments of the present disclosure.
Figure 12:
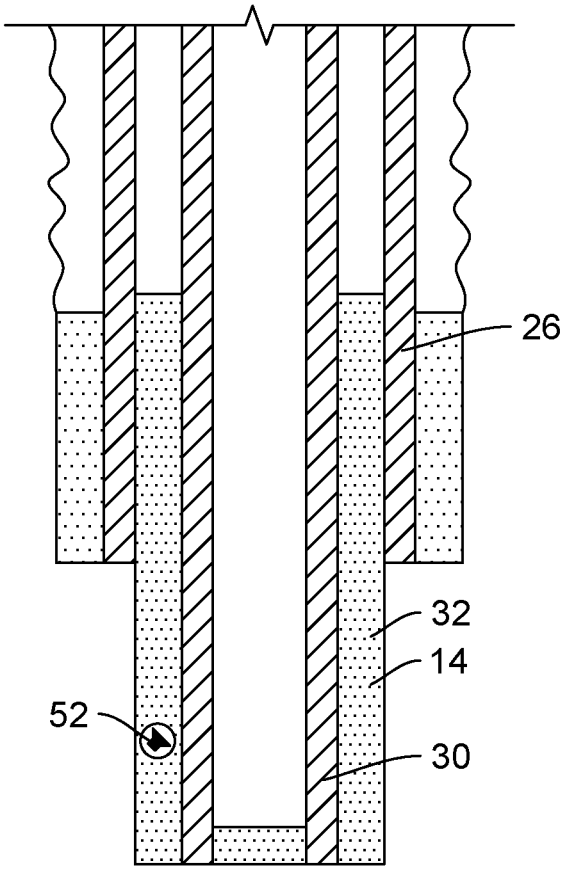

FIG. 12 illustrates an example configuration for utilizing an ultrasonic device in accordance some embodiments of the present disclosure. As depicted in FIG. 12, one or more ultrasonic tools 52 is included in cement slurry 14, both of which may be pumped into wellbore annulus 32. In further examples, ultrasonic tool 52 may be powered by a battery or any other local source of power. In such examples, ultrasonic tool 52 may begin to emit ultrasonic waves at any point during the cementing operation including before being pumped into wellbore 22, while being pumped into wellbore 22, or after being place in wellbore annulus 32. In some examples ultrasonic tool 52 may be battery powered.

The exemplary cement compositions disclosed herein may directly or indirectly affect one or more components or pieces of equipment associated with the preparation, delivery, recapture, recycling, reuse, and/or disposal of the disclosed cement compositions. For example, the disclosed cement compositions may directly or indirectly affect one or more mixers, related mixing equipment, mud pits, storage facilities or units, composition separators, heat exchangers, sensors, gauges, pumps, compressors, and the like used generate, store, monitor, regulate, and/or recondition the exemplary cement compositions. The disclosed cement compositions may also directly or indirectly affect any transport or delivery equipment used to convey the cement compositions to a well site or downhole such as, for example, any transport vessels, conduits, pipelines, trucks, tubulars, and/or pipes used to compositionally move the cement compositions from one location to another, any pumps, compressors, or motors (e.g., topside or downhole) used to drive the cement compositions into motion, any valves or related joints used to regulate the pressure or flow rate of the cement compositions, and any sensors (i.e., pressure and temperature), gauges, and/or combinations thereof, and the like. The disclosed cement compositions may also directly or indirectly affect the various downhole equipment and tools that may come into contact with the cement compositions such as, but not limited to, wellbore casing, wellbore liner, completion string, insert strings, drill string, coiled tubing, slick line, wireline, drill pipe, drill collars, mud motors, downhole motors and/or pumps, cement pumps, surface-mounted motors and/or pumps, centralizers, turbolizers, scratchers, floats (e.g., shoes, collars, valves, etc.), logging tools and related telemetry equipment, actuators (e.g., electromechanical devices, hydro mechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like.

Accordingly, the present disclosure may provide methods, systems, and apparatus that may relate to methods of designing cement compositions. The methods, systems. And apparatus may include any of the various features disclosed herein, including one or more of the following statements.

Statement 1. A method comprising: introducing an ultrasonic device into a wellbore with a cement slurry therein; generating ultrasonic waves with the ultrasonic device, wherein at least a portion of the ultrasonic waves are transmitted into at least a portion of the cement slurry; creating cavitation within at least the portion of the cement slurry with at least the portion of the ultrasonic waves; and allowing the cement slurry to set to form a hardened mass.

Statement 2. The method of statement 1, wherein the cement slurry comprises a hydraulic cement and water.

Statement 3. The method of statement 1 or 2, wherein the ultrasonic waves are continuous ultrasonic waves.

Statement 4. The method of any of the preceding statements, wherein the ultrasonic device generates continuous ultrasonic waves at multiple depths in the wellbore.

Statement 5. The method of any of the preceding statements, wherein the portion of the cement slurry is subjected to acoustic cavitation for a period of about 5 seconds to about 15 minutes.

Statement 6. The method of any of the preceding statements, wherein the ultrasonic waves cause a temperature rise of about 10° C. to about 50° C. within the portion of the cement slurry.

Statement 7. The method of any of the preceding statements, wherein the ultrasonic device emits the ultrasonic waves at a frequency of about 20 Hz to about 2 MHz.

Statement 8. The method of any of the preceding statements, wherein the ultrasonic device emits the ultrasonic waves at a frequency of about 15 kHz to about 30 kHz.

Statement 9. The method of any of the preceding statements, wherein the ultrasonic device is disposed within the wellbore or within an annular space of the wellbore.

Statement 10. The method of any of the preceding statements, wherein the ultrasonic device is disposed on at least one piece of wellbore equipment selected from the group consisting of a casing component, a wellhead component, a cementing head, a casing running tool, and combinations thereof.

Statement 11. The method of any of the preceding statements, wherein the ultrasonic device is disposed on at least one element selected from the group consisting of a wireline tool, a wellbore isolation tool, a wiper plug, a casing component, a casing centralizer, a tubular string, a wellhead component, a casing running tool, and combinations thereof.

Statement 12. A method comprising: generating ultrasonic waves with an ultrasonic device, wherein at least a portion of the ultrasonic waves are transmitted into at least a portion of a cement slurry, and wherein the cement slurry is disposed in a wellbore; creating cavitation within at least the portion of the cement slurry with at least the portion of the ultrasonic waves; and allowing the cement slurry to set to form a hardened mass.

Statement 13. The method of statement 12, further comprising introducing the ultrasonic device into the wellbore on a conveyance.

Statement 14. The method of statement 13, wherein the conveyance comprises at least one conveyance selected from the group consisting of a wireline, an electric line, a slick line, and combinations thereof.

Statement 15. The method of statement 12, further comprising introducing the ultrasonic device into the wellbore on a tubular running tool.

Statement 16. The method of statement 15, wherein the tubular running tool comprise at least one tool selected from the group consisting of a work string, a drill pipe, a production tubular, coiled tubing, and combinations thereof.

Statement 17. The method of statement 12, further comprising introducing a top plug into the wellbore, wherein the ultrasonic device is disposed within the top plug.

Statement 18. The method of any one of statements 12 to 17, wherein the portion of the cement slurry is subjected to acoustic cavitation for a period of about 5 seconds to about 15 minutes.

Statement 19. The method of any one of statements 12 to 18, wherein the ultrasonic waves cause a temperature rise of about 10° C. to about 50° C. within the portion of the cement slurry.

Statement 20. The method of any one of statements 12 to 19, wherein the ultrasonic device emits the ultrasonic waves at a frequency of about 20 Hz to about 2 MHz.

It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the illustrative embodiments disclosed above may be altered or modified and all such variations are considered within the scope and spirit of the present disclosure. If there is any conflict in the usages of a word or term in this specification and one or more patent(s) or other documents that may be incorporated herein by reference, the definitions that are consistent with this specification should be adopted.

What is claimed is:

1. A method comprising:

introducing an ultrasonic device into a wellbore with a cement slurry therein, wherein the ultrasonic device is disposed on at least one element selected from the group consisting of a wellbore isolation tool, a cementing head, casing running tool, a wiper plug, a wellhead component, and combinations thereof;

generating ultrasonic waves with the ultrasonic device, wherein at least a portion of the ultrasonic waves are transmitted into at least a portion of the cement slurry;

creating cavitation within at least the portion of the cement slurry with at least the portion of the ultrasonic waves; and allowing the cement slurry to set to form a hardened mass.

2. The method of claim 1, wherein the cement slurry comprises a hydraulic cement and water.

3. The method of claim 1, wherein the ultrasonic waves are continuous ultrasonic waves.

4. The method of claim 1, wherein the ultrasonic device generates continuous ultrasonic waves at multiple depths in the wellbore.

5. The method of claim 1, wherein the portion of the cement slurry is subjected to acoustic cavitation for a period of about 5 seconds to about 15 minutes.

6. The method of claim 1, wherein the ultrasonic waves cause a temperature rise of about 10° C. to about 50° C. within the portion of the cement slurry.

7. The method of claim 1, wherein the ultrasonic device emits the ultrasonic waves at a frequency of about 20 Hz to about 2 MHz.

8. The method of claim 1, wherein the ultrasonic device emits the ultrasonic waves at a frequency of about 15 kHz to about 30 kHz.

9. The method of claim 1, wherein the ultrasonic device is disposed within the wellbore or within an annular space of the wellbore.

10. A method comprising:

introducing a top plug into a wellbore, wherein an ultrasonic device is disposed within the top plug;

generating ultrasonic waves with the ultrasonic device, wherein at least a portion of the ultrasonic waves are transmitted into at least a portion of a cement slurry, and wherein the cement slurry is disposed in the wellbore;

creating cavitation within at least the portion of the cement slurry with at least the portion of the ultrasonic waves; and allowing the cement slurry to set to form a hardened mass.

11. The method of claim 10, further comprising introducing an additional ultrasonic device into the wellbore on a conveyance.

12. The method of claim 11, wherein the conveyance comprises at least one conveyance selected from the group consisting of a wireline, an electric line, a slick line, and combinations thereof.

13. The method of claim 10, further comprising introducing an additional ultrasonic device into the wellbore on a tubular running tool.

14. The method of claim 13, wherein the tubular running tool comprise at least one tool selected from the group consisting of a work string, a drill pipe, a production tubular, coiled tubing, and combinations thereof.

15. The method of claim 10, wherein the portion of the cement slurry is subjected to acoustic cavitation for a period of about 5 seconds to about 15 minutes.

16. The method of claim 10, wherein the ultrasonic waves cause a temperature rise of about 10° ° C. to about 50° C. within the portion of the cement slurry.

17. The method of claim 10, wherein the ultrasonic device emits the ultrasonic waves at a frequency of about 20 Hz to about 2 MHz.

* * * * *